United States Patent [19]

Bytheway, Jr.

[11] Patent Number: 4,651,794

[45] Date of Patent: Mar. 24, 1987

[54] V CLOSURE SYSTEM FOR BLINDS

[76] Inventor: Mervin H. Bytheway, Jr., 9135 Golden Gate Ave., Orangevale, Calif. 95662

[21] Appl. No.: 593,082

[22] Filed: Mar. 26, 1984

[51] Int. Cl.[4] ..... E06B 9/30

[52] U.S. Cl. ..... 160/168 R; 160/176 R; 160/115

[58] Field of Search ..... 160/34, 174–178 E, 160/166, 168, 173, 115, 116, 114

[56] References Cited

U.S. PATENT DOCUMENTS

| | | | |
|---|---|---|---|
| 167,942 | 9/1875 | Sedman | 160/178 F |
| 1,233,781 | 7/1917 | Hough | 160/176 |
| 2,202,752 | 5/1940 | Brenner | 160/173 |
| 3,055,419 | 9/1962 | Rubin et al. | 160/348 |
| 4,076,068 | 2/1978 | Archer et al. | 160/168 R X |
| 4,484,612 | 11/1984 | Vecchiarelli | 160/177 |
| 4,494,593 | 1/1985 | Fielder, Jr. | 160/177 |
| 4,503,900 | 3/1985 | Osaka | 160/176 R |

FOREIGN PATENT DOCUMENTS

| | | | |
|---|---|---|---|
| 199578 | 2/1965 | Sweden | 160/173 |
| 265134 | 2/1950 | Switzerland | 160/133 |

*Primary Examiner*—Ramon S. Britts
*Assistant Examiner*—David M. Purol
*Attorney, Agent, or Firm*—Mark C. Jacobs

[57] ABSTRACT

A window covering combining the features of a pleated shade and a mini-blind which in the open position resembles a mini-blind and in a closed position resembles a pleated shade. Apparatus to further diminish light transmission between adjacent slats of the window covering is also included.

14 Claims, 13 Drawing Figures

V CLOSURE SYSTEM FOR BLINDS

BACKGROUND OF THE INVENTION

Window treatment, namely the art of decorating the interior of a window, has been subject to fashion change over the years. Earlier in the century spring loaded pull up shades and two inch blinds called venetian blinds were in vogue. In the sixties the use of drapes rather than blinds or shades was practiced by the interior decorators of that time. In the early seventies Roman shades, which were rolled up from the bottom toward the top by a drawstring, were considered chic. In the late seventies mini-blinds, i.e. those of one (1) inch depth came into fashion as the preferred window treatment. Today the mini-blind continues to be fashionable along with the pleated shade. Pleated shades are constructed of horizontal pleats of a single piece of fabric. They operate much like the shades of old in that viewing can only take place to the extent that the shades are drawn open, i.e. raised upwardly from the bottom of the window. As is well known, blinds on the other hand offer viewing capability without the necessity of raising them upwardly. The mere traverse of the blind permits the slats to be oriented parallel to one another, thereby letting light in from the window. This is considered an advantage in view of the fact that both children and infirm persons can operate mini-blinds to change the condition from light emitting to light prevention with minimal effort in contrast to the operation of a shade or pleated shade. On the other hand, many people find that they prefer the fashion appearance of the pleated shade as opposed to the overlapping slats of the mini-blind during such times as the shades are in the room darkening position.

It is an object, therefore, of this invention to provide a mini-blind which has the operation of a mini-blind with respect to the light passage capability yet retains the fashionable good looks of a pleated shade.

It is another object of this invention to provide a mini-blind that has a higher thermo-coefficient than the standard mini-blind.

Another object is to provide a mini-blind that more readily lends itself to the use of different colored alternating slats.

A further object is to provide a process for manufacturing a unique mini-blind that in the closed position resembles a pleated shade.

The invention accordingly comprises the product possessing the features, properties and the relation of components which are exemplified in the following detailed disclosure, and the scope of the application of which will be indicated in the claims.

For a fuller understanding of the nature and objects of the invention, reference should be had to the following detailed description taken in connection with the accompanying drawings.

While attempts have been made to simulate or approach the instant invention, such structures have been devised previously. Thus reference is made to U.S. Pat. No. 2,049,518 which though entitled Venetian blind, is in fact a pleated shade.

SUMMARY OF THE INVENTION

A mini-blind using a two ladder, cable ladder system, one of which ladders crosses under the drum for attachment thereto, while the other of which is conventionally attached to the drum. The combination gives rise to an improvement to a mini-blind that appears conventional in open position, and appears like a pleated shade in closed position.

BRIEF DESCRIPTION OF THE DRAWINGS

FIG. 8 is a close-up end view of the closed position of a blind according to this invention.

DESCRIPTION OF THE PREFERRED EMBODIMENT

For the ease and convenience of the reader, it was felt that an introduction to the venetian blind, originally introduced in the 1940's, would be of benefit in understanding the instant invention. While we are all familiar with the results of operating a venetian blind, we are not necessarily cognizant of how they in fact work.

Venetian blinds, when first introduced, were of 2 inch depth and were indeed called Venetian blinds. More recently however, the slat depth has been reduced to 1 inch, and the reference term now used is mini-blinds. For brevity they shall be referred to merely as blinds, since they are structurally the same.

Figure 1:
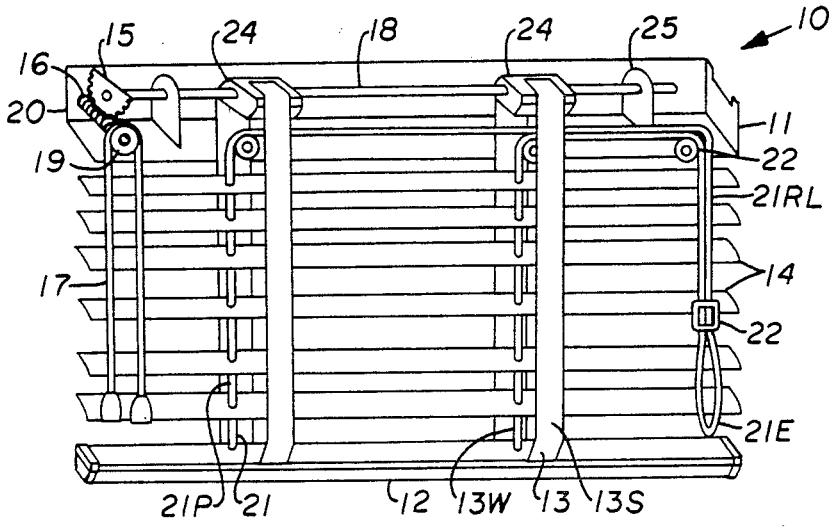
PRIOR ART FIG. 1
FIG. 1 is a front elevational view of a mini-blind of the prior art in the open or light passage position.

In the prior art FIG. 1, an older style blind is shown. This fact is recognized by the use of a tilt cord 17, rather than the tubular wand now used tc open and close the blind; and by the use of wide fabric tapes 13. Today the side cables, ladder cables, are of braided rope rather than 1" wide fabric commonly referred to as tapes.

LEXICON

10—Inventive Unit
11—Head
12—Bottom Rail
13—Cable or Tape Ladder (Ladder "2 cables and rungs)
13S—Side tapes (side cables) two in number; a front and a rear
13R—Rung, the connection between front and rear cables
14—Slats—alternately designated A and B. They rest on rungs
15—Tilter
16—Worm gear
17—Tilt chord
18—Tilt Rod 19—Tilt Chord Pulley
20—Head Channel
21—11 Ft cord
133—ladder
134—slats
144—rung Cable ladder system—a pair of cable ladders. The minimum number needed for a blind is two systems. Thus the V-closure blind of this invention requires a left A, and a left B ladder, (1 system) a right A and a right B ladder (1 system). One A and one B taken together form a System comprised of a pair of ladders. At least two systems, depending on blind width, are employed.

It is seen that the blind 10 comprises a head section 11 from which are suspended a series of slats 14, the lowest of which is designated the bottom rail 12. The tape ladder 13 consisting of rung 13R and side tapes 13S hold the plurality of spaced tapes in a spaced relationship parallel to each other. The side tapes 13S are outside to the slats, while the lift cord 21, consisting of segments 21P and 21RL and 21E has its segment 21P pass through the plurality of slats 14. The designators 21 RL means raise and lower and 21E is the end of the cord.

Unlike a fireman's or household ladder, the side tapes herein have the rungs flexibly attached to the side tapes. Reference is made to any prior art venetian blind. Here, the rungs are tied in a knot on opposite ends to their respective side tapes. The current day version of side tape 13S, is a thin cable. But since the element functions in like manner, viz a viz the entire structure, the designation 13S is retained. To distinguish the use of the term rung from seat, the latter rests upon a rung; while a latter is the entire structure, side cable and rungs.

Designator 15 is the tilter or tilting gear that engages the worm gear 16 upon actuation by operator movement of the tilt cord 17, or rotation of the tilt wand if such is employed.

The tilt rod 18, the tilter and worm gear aforesaid and the drums 24 to which the ladder cables 13, are attached at the top, and the cradles 25 are all deployed in a U-shaped channel designated as the head channel or head rail, 20.

Figure 2:
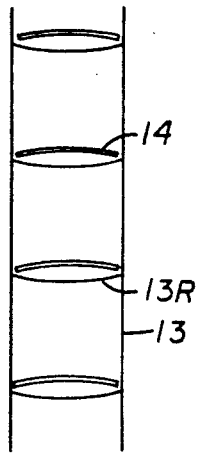
FIG. 2 is an end elevational view of a conventional blind.

In this prior art unit, it is seen that along the width of the blind that two ladders are employed. Each location for a ladder is of a single ladder 13 upon whose rungs 13R rest a single slat 14. Reference is made to FIG. 2.

Figure 3:
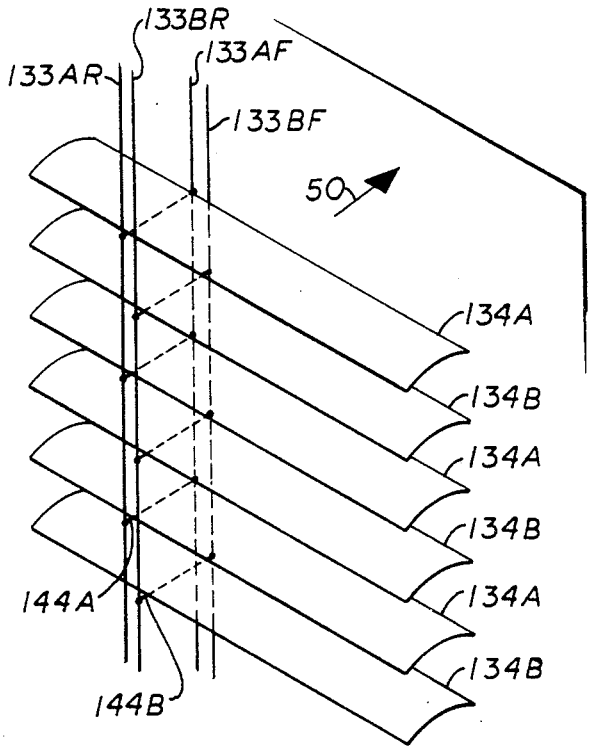
FIG. 3 is a close-up perspective view illustrating the instant invention.

On the other hand, in the instant invention, each drum employs a cable ladder system that constitutes a pair of ladder cables, each of which is positioned adjacent the other. That is, a pair of ladders are used at each drum location along the width of the blind. Here one ladder is designated 133A while the other is designated 133B. Each of the two ladders 133A and 133B each support alternate rungs, designated A and B of 144 respectively. Reference is made to FIG. 3. While the distance between slats is the same as in a conventional blind, the distance between adjacent rungs on any one cable is twice that of a conventional ladder, since each ladder only supports half of the slats on its rungs.

As is seen in FIG. 3, the little dots designated 144 ARK and 144 AFK constitute the knots of the junction of the Ladder 144A to the vertical cables 133 AR and 133 AF. The B slat 134B is supported on Ladder 144B, which is attached to the vertical cables at the knots 144 BRK and 144 BFK on the other pair of vertical cables namely those designated 133 BR and 133 BF.

Now refer again to FIG. 3. Note that the next A slat either up or down from any particular B slat is supported in the same manner as the first A slat referenced by the reader. But note that the spacing between the two A slats is equal to the sum of, the spacing between the first A slat and the B slat, and the spacing between the B slat and the second A. Since as is seen in FIG. 3, these spacings are equal, it can be said that any two A slats, 134A are double spaced with respect to each other.

In FIG. 3 it is to be seen that just as there are A slats and B slats, so, too, are there A and B ladders as aforesaid. It is important to note the second designator, namely F and R. These designate the front and rear side cable of the A and B ladders respectively. Arrow 50 points toward the window 51 to correctly position the blind. It should also be understood that the ladder in FIG. 3 are discontinuous, i.e., they terminate before the head channel, for ease of understanding. The rungs are designated 144A and 144B corresponding to the cables A or B to which they are knottingly secured.

Figure 6:
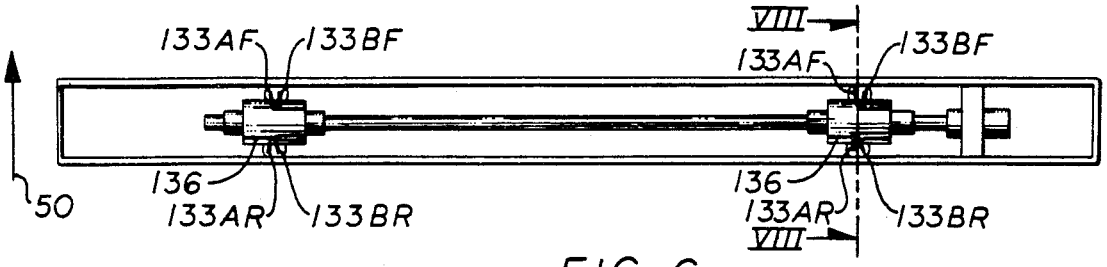
FIG. 6 is a top plan view of the head portion of a blind according to this invention.

FIG. 6 which is a top plan view of a blind's U-channel 20 showing the various components does not show the presence of the ladders. This is because any standard head and components can be readily adapted to employ the instant invention.

Figure 4:
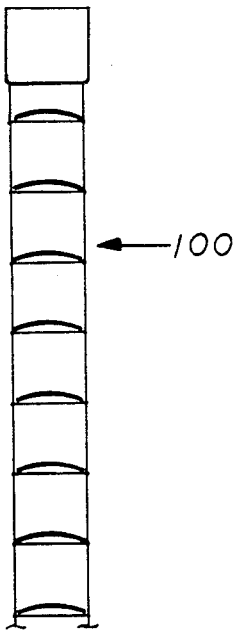
FIG. 4 is a right side elevational view of a mini-blind according to this invention in the open position.

In FIG. 4 there is depicted the blind of this invention in the open position. Here the blind 100 as seen from the right side has the appearance of the prior art blind 10 as described in the discussion of FIG. 1.

Figure 5:
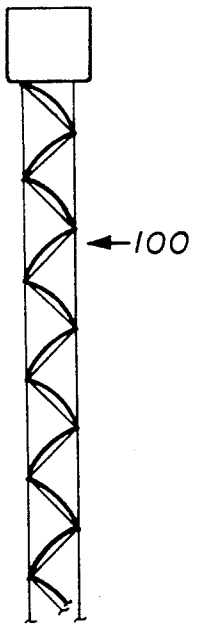
FIG. 5 is a right side elevational view of a mini-blind of this invention in a closed position.
Figure 7:
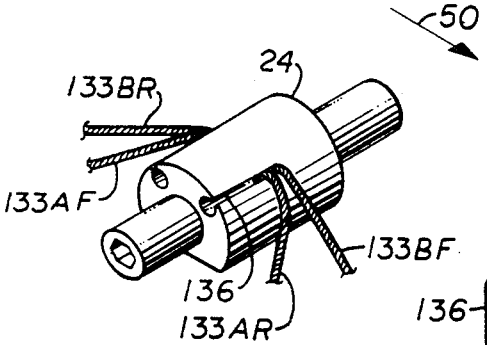
FIG. 7 is a diagrammatic view of a part of the head portion of the instant mini-blind.
Figure 8:
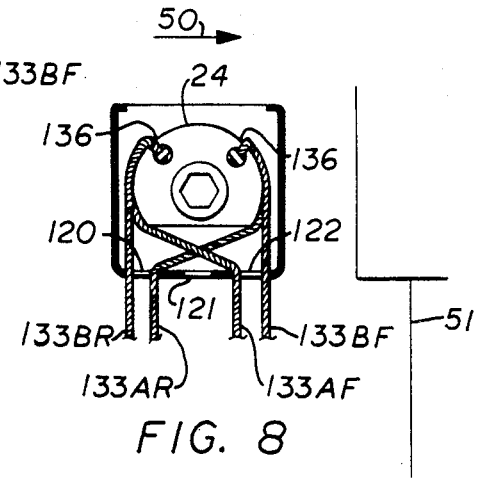
FIG. 8 is a close-up, end view of a tape drum according to this invention.
Figure 13:
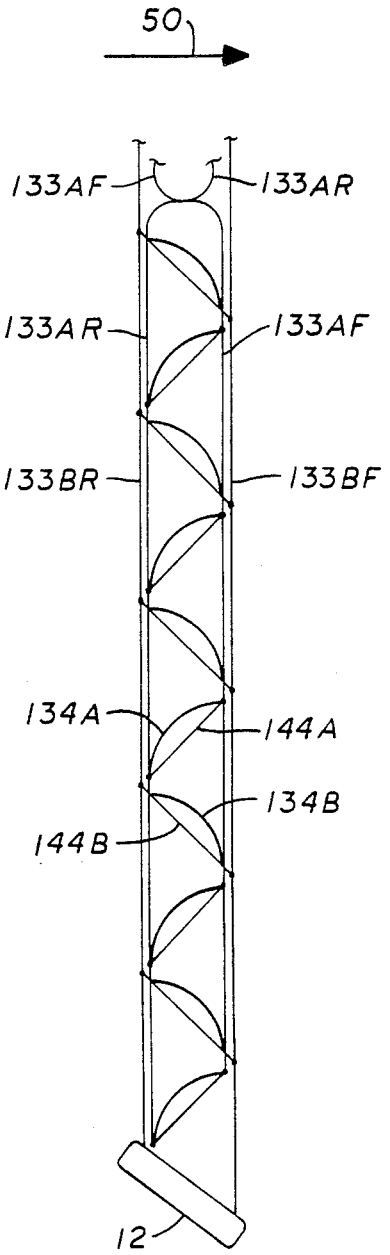
FIG. 13 is a diagrammatic view similar to FIG. 5.

But, when the wand is oriented to close the blind, as in FIG. 5 and FIG. 13, the blind takes on the appearance of a pleated shade. That is, one slat tilts downwardly while the next slat tilts upwardly to close. This is more easily understood by referring to FIGS. 3, 7 and 8. Drum 24, a conventional drum having two slots for conventional cable receiving beads, is seen to receive the rear side cable of the A ladder at the front thereof, and the front side cable of the B ladder. Since the use of these beads is conventional in the art, it is deemed unnecessary to disclose same in the figures or to elaborate further about them, other than to say such beads are drilled to receive the end of the ladder cable, and the beads have disposed thereon a crimp for securing the ladder cable to the bead. These are designated 133 AR and 133 BF respectively. Reference should now be had to FIG. 8 which illustrates how the B ladder has its front cable side 133 BF connect to the front of the drum and its rear cable side 133 BR connect to the rear of the drum. This is the conventional hookup of a ladder in a blind. Observe the A ladder shown in FIG. 8 it crosses under the drum 24 within the channel 20 and attaches on opposite sides of the drum. The designators 120,121 and 122 pertain to bores in the bottom wall of the U-channel, through the first and last of which pass the cords or side cables of the ladders.

Thus it can be understood how, when tilting the tilter 15, whereby the drum 24 rotates forwardly, the B slats 134B will have their fronts tilt downwardly in the same arcuate pattern as the movement of the drum, while the A slats will move upwardly in the front, i.e. go counterclockwise to thus achieve the closed effect shown in FIG. 5.

As in conventional blinds, here too, the number of drums depends on the width of the shade. Two is minimum, three and four are common. Each would have the double ladder system described above.

No time has been spent discussing the mode of attachment of the ladder cables to the drum. This, as is known, is done by crimping a bead, not seen, on the end of the cable, and sliding same into a slot such as 136 in FIG. 7 or 8. The use of such a ladder cable mounting system is known to the art.

In recapitulation, it is seen in FIG. 13 how the pleated concept appears diagrammatically in the closed position. Refer back to FIG. 4 for the open position. In FIG. 13, for ease of understanding, the A and B slats have been so designated, while the head section has not been included.

As is specifically shown in FIG. 13, the A ladder 133A terminates at a rung 144A. next to the bottom rail 12, while the B ladder terminates at the bottom rail 12. This procedure is necessary in order to have the inherent movement of A and B cables' slats going in opposite directions, i.e. one up, one down.

Figure 9:
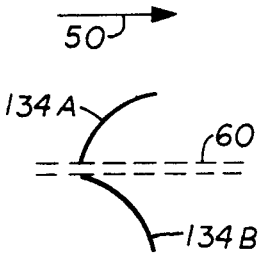
Figure 10:
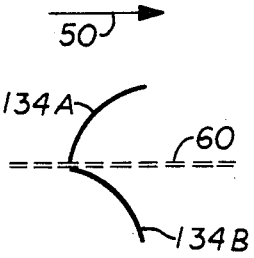
FIG. 10 is a close-up end view of a variant thereof.
Figure 11:
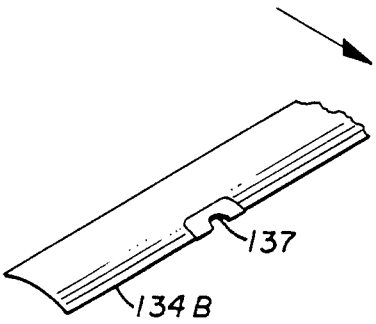
FIG. 11 is a top perspective view of a slat modified in accordance with this invention.
Figure 12:
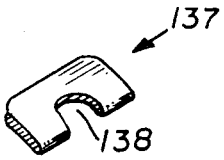
FIG. 12 is a an enlarged perspective view on one element the device shown in FIG. 11.

In order to have an even tighter pleat, i.e. with an even smaller bar of light pass horizontally through in the closed position, reference should be made to FIGS. 9 and 10. For ease of understanding the ropes or sidewalls of the ladders have been omitted. The reference arrow 50 is included to show the front of rear of the blind in question. Here bar of light 60 (referred to as such since this is the appearance when facing the blind) represents the relative size of the bar when blinds produced according to this invention are closed. But when these blinds are further modified, the light bar can be narrowed down to the relative height of light bar 61 of FIG. 10. This is achieved by notching alternate slats at the point of impact of the cables of the ladders. These notches, which extend inward about 1/8th inch or so are placed on the down side of the A and the down side of the B slat. In FIG. 11, slat 134B is shown modified according to this invention. Here a metal clip 137 which is generally C-shaped in both top view and cross-section per FIG. 12 is placed over a small notch in the top slat. Optionally, clip 137 serves to strengthen the cut area and to keep the cut area from propagating. Clip 137 is formed preferably from spring steel to achieve a tight fit on the front of the slat. The opening 138 generally corresponds to the size of the notch cut into the slat. This size is large enough to accommodate the two ladder cables employed in this invention. Thus the location of the notch and clip are specific to receive the cables, thus permitting a tighter closure of the A slat against the B slat.

Preferably a clip 137 is employed at least on the top slat, i.e. just beneath head section 11, and on the most lower slat, just above the bottom rail 12. These are the key pressure zones of the ladder cables upon the slats.

The clips shown or any conventional clip adapted for the intended purpose, and available in the marketplace, may be employed. While clips per se are known, but not for the reason they are employed herein, the use of alternately notched slats. said notches being on the down side of the slat is new to this invention.

While the discussion has shown the A ladder being attached to the top most slat, the B ladder could be so attached to the second top most slat to alternate the pattern.

The blinds of this invention can employ metal or plastic slats of any color, or of different colors such as having a top of the slat in one color and the bottom of another color.

It is seen that I have provided an improved mini-blind that combines the operation of a mini-blind with the appearance of the high fashion pleated shade. At the same time I have provided a mini-blind that is a higher thermo-coefficient in that it will retain the heat and keep out the cold better than a standard mini-blind in view of the closer fit of adjacent slats in the closed position. The device of this invention can be easily manufactured by those currently in the mini-blind business with a minimal effort required to convert their manufacturing facility. Therefore, this product can be made available to the marketplace, cheaply, easily and quickly.

Since certain changes may be made in the above apparatus without departing from the scope of the invention herein involved, it is intended that all matter contained in the above description and shown in the accompanying drawings shall be interpreted as illustrative and not in a limiting sense.

I claim:

1. In a venetian blind having a head channel housing a tilter, and at least two drums; a lift cord; a plurality of parallel spaced slats supported on cable ladders;

and at least two cable ladder systems; the number of ladder systems corresponding to the number of drums, the improvement comprising each ladder system consisting of an A ladder B ladder, each of said ladders having a pair of spaced vertical side cables interconnected by horizontal rungs, each of which ladders supports alternate slats on its rungs, the rungs on each ladder are arranged in a correlative spacing to each other which is double the spacing of two adjacent slats, the cables of which ladders are designated as the front cables and the back cables, the A ladder's back cable crossing under the drum and being attached to the front thereof, and the A ladder's front cable crossing under the drum and being attached to the rear thereof;

the B ladder's front cable being attached to the front of the drum and its back cable being attached to the back of the drum.

2. In the device of claim 1, wherein the A ladder is attached to the top most slat.

3. In the device of claim 1 wherein the B ladder is attached to the second top most slat.

4. In the device of claim 1 further including a tilt wand interconnected to the tilter for opening and closing the blind.

5. In the device of claim 1 further including a tilt cord interconnected to the tilter for opening and closing the blind.

6. In the device of claim 1 wherein the blind's ladders comprise two cable ladder systems, one at each end thereof.

7. In the device of claim 1 wherein each ladder of the ladder system constitutes a braided cord.

8. In the device of claim 1 wherein each slat is notched on its down edge adjacent each ladder.

9. In the device of claim 8 wherein the top slat notch is reinforced by a C-shaped clip surrounding said notch.

10. In the device of claim 9 wherein the top and bottom slats are notched.

11. In the device of claim 9 wherein the top and bottom slats each have a notch and a clip.

12. A new cable ladder system for use in a V-closure venetian blind, which blind includes, a head channel housing a tilter and at least two drums; which ladder system comprises at least one pair of ladders having vertically spaced rungs, a plurality of spaced slats supported in said rungs, each of which ladders has a pair of horizontally spaced cables, a front one and a back one, and a plurality of said vertically spaced rungs secured to each of said respective pair of cables normal thereto; wherein the vertical spacing between each rung on said at least one pair of ladders is the same on both ladders of the pair, and wherein the spacing between adjacent rungs on the same ladder of both individual ladders of the pair of ladders of the cable ladder system is twice the distance between any two adjacent slats supported on rungs of either ladder, and while the spacing vertically between each rung on each ladder is the same, the rungs on one ladder of the pair are vertically offset uniformly 50% of the distance between adjacent rungs on the other of said pair of ladders, and wherein both ladders of each pair of ladders in the cable ladder system have the spacing between front and back cables substantially the same.

13. In the cable ladder system of claim 12 wherein the system includes a pair of equal length ladders, and wherein the rungs of a first ladder of said pair of ladders are vertically disposed half way between the rungs of the second ladder of said pair.

14. In the cable ladder system of claim 12 wherein the system includes a pair of ladders and wherein the spacing between each adjacent pair of rungs in each of the ladders is twice the spacing between rungs in ladders of conventional venetian blinds having ladders of the same height as the ladders of the system.

* * * * *